US005791892A

United States Patent [19]

Döbbeling et al.

[11] Patent Number: 5,791,892

[45] Date of Patent: Aug. 11, 1998

[54] PREMIX BURNER

[75] Inventors: Klaus Döbbeling, Windisch; Adnan Eroglu, Untersiggenthal, both of Switzerland; Peter Senior, Leicester, Great Britain

[73] Assignee: ABB Research Ltd., Zurich, Switzerland

[21] Appl. No.: 744,301

[22] Filed: Nov. 6, 1996

[30] Foreign Application Priority Data

Nov. 23, 1995 [DE] Germany ..... 195 43 701.2

[51] Int. Cl.[6] ..... F23Q 9/00

[52] U.S. Cl. ..... 431/284; 431/285; 431/175; 431/183; 431/354

[58] Field of Search ..... 431/354, 284, 431/285, 175, 183, 185

[56] References Cited

U.S. PATENT DOCUMENTS

| | | | |
|---|---|---|---|
| 3,958,416 | 5/1976 | Hammond, Jr. et al. . | |
| 4,094,625 | 6/1978 | Wang et al. | 431/284 |
| 4,701,124 | 10/1987 | Maghan et al. | 431/284 |
| 5,518,395 | 5/1996 | Maughan | 431/183 |

FOREIGN PATENT DOCUMENTS

| | | |
|---|---|---|
| 0321809B1 | 6/1989 | European Pat. Off. . |
| 0619133A1 | 10/1994 | European Pat. Off. . |
| 0619456A1 | 10/1994 | European Pat. Off. . |
| 0620362A1 | 10/1994 | European Pat. Off. . |
| 3149581C2 | 11/1982 | Germany . |
| 3512702A1 | 10/1986 | Germany . |
| 3835354A1 | 4/1990 | Germany . |

*Primary Examiner*—Carroll B. Dority

*Attorney, Agent, or Firm*—Burns, Doane, Swecker & Mathis, L.L.P.

[57] ABSTRACT

In a premix burner for the combustion of gaseous and/or liquid fuel, in which the fuel is injected as secondary flow into a gaseous, ducted main flow, the premix duct (20) through which flow occurs being annular and being defined by an inner (21*a*) and an outer cylinder wall (21*b*), and the main flow being guided via vortex generators (9, 9*a*) which generate longitudinal vortices without a recirculation area and of which a plurality are arranged next to one another over the periphery of the annular duct (20) on at least one duct wall (21), and means for injecting fuel being arranged directly downstream of the vortex generators (9, 9*a*) on the inner and/or outer duct wall (21*a*, 21*b*), the vortex generators (9, 9*a*) generate such vortices which leave behind a residual vortex after the complete mixing of the fuel with the air of the fuel/air mixture flow. In this case, the annular main flow duct (20) of constant height (H) has a length (L) downstream of the vortex generators (9) and the fuel injection which is in the region of 5 to 20 times its height (H). It subsequently widens to form a circular main flow duct.

17 Claims, 6 Drawing Sheets

PREMIX BURNER

BACKGROUND OF THE INVENTION

1. Field of the Invention

The invention relates to a premix burner for the combustion of gaseous and/or liquid fuel, in which the fuel is injected as secondary flow into a gaseous, ducted main flow, the secondary flow having a substantially smaller mass flow than the main flow.

2. Discussion of Background

EP 0 321 809 B1 discloses a premix burner which is distinguished by low NOx emission values (about 25 ppm) and high flame stability. This premix burner, also called double-cone burner, consists of hollow conical sectional bodies complementing one another to form one body and having tangential air-inlet slots for the combustion air flowing forward from the compressor as well as feeds for gaseous and liquid fuels, the center axes of the hollow conical sectional bodies having conicity widening in the direction of flow and running offset from one another in the longitudinal direction. A fuel nozzle for the liquid fuel is arranged in the interior of the burner (apex of cone), through which fuel nozzle the fuel is injected at an acute angle into the hollow cone. The resulting conical liquid-fuel profile is enclosed by the tangentially rotating combustion-air flow, the concentration of the fuel constantly decreasing in the axial direction as a result of the mixing with the combustion air. The premix burner may also be operated with gaseous fuel or in mixed operation. In this case, the mixture formation of the gaseous fuel with the combustion air takes place in the tangential air-inlet slots, into which the gaseous fuel is introduced via uniformly distributed nozzles.

In order to obtain reliable ignition of the mixture at the outlet of the burner and adequate burn-up, intimate mixing of the fuel with the air is necessary. Axially oriented vortices of the fuel/air mixture arise in the interior space of the double-cone burner due to the type of injection. When the vortex coefficient has reached a critical value, the vortex breakdown is effected and a stable flame front forms downstream of the burner outlet.

A further lasting reduction in the pollutant emissions of the double-cone burners, for example to NOx values of less than 9 ppm, is not possible by changing the operating conditions on account of the problems which occur with regard to flame stability, pulsation and the ever increasing combustion temperatures.

A further disadvantage of the double-cone burners consists in their complicated geometric shape and the difficulties in production which are caused by this.

EP 0 619 456 A1 discloses a fuel-feed system for a combustion chamber having premix combustion in which a gaseous and/or liquid fuel is injected as secondary flow into a gaseous, ducted main flow, the secondary flow having a substantially smaller mass flow than the main flow, and the premix duct through which flow occurs having curved walls. In one embodiment, the duct is annular, and an identical number of vortex generators are lined up in the peripheral direction on both the outer and the inner annular wall.

These vortex generators have three surfaces which extend in the direction of flow and around which flow occurs freely and of which one forms the top surface and the other two form the side surfaces. The side surfaces are flush with the same duct wall and enclose a sweepback angle $\alpha$ with one another. The top surface, with an edge running transversely to the duct through which flow occurs, bear against the same duct wall as the side surfaces, and the longitudinally directed edges of the top surface, which are flush with the longitudinally directed edges of the side surfaces projecting into the flow duct, run at a setting angle $\Theta$ to the duct wall. Half vortex generators are also possible, in which only one of the two side surfaces of the vortex generator is provided with a sweepback angle $\alpha/2$, whereas the other side surface is straight and oriented in the direction of flow. In this case, the connecting edges of two opposite vortex generators each can lie on the same radial line or be offset by half a pitch.

This known fuel-feed system according to EP 0 619 456 A1 ensures that combustion air and fuel are intimately mixed in a very short section and a uniform velocity distribution is achieved in the mixing zone at the same time. However, there are no statements here with regard to achieving adequate flame stability. Nor is flame stabilization necessary in this case, since this fuel-feed system is used for a self-igniting combustion chamber.

SUMMARY OF THE INVENTION

Accordingly, one object of the invention is to provide a novel premix burner for the combustion of gaseous and/or liquid fuel, with which extremely low NOx emissions are obtained, in which case the burner is to be distinguished by simple geometry and a reliable operating behavior. In the burner, intimate mixing of combustion air and fuel is to be achieved within the shortest section at a simultaneous uniform velocity distribution in the mixing zone, and furthermore flashback of the flame is to be reliably avoided with such a burner without using a mechanical flame retention baffle.

According to the invention, this is achieved by virtue of the fact that, in a premix burner according to the preamble of claim 1, which works with a fuel-feed system which is disclosed by EP 0 619 456 A1, the vortex generators used generate such vortices which leave behind a residual vortex after the mixing of the fuel with the air of the fuel/air mixture flow, the annular main flow duct of constant height and formed by the duct walls has a length downstream of the vortex generators and the fuel injection which is in the region of 5 to 20 times its height, and the annular main flow duct subsequently widens by closing the inner cylinder wall to form a circular main flow duct.

The advantages of the invention consist in the fact that, on the one hand, intensive complete mixing of fuel and combustion air is effected in a very short mixing section without separation areas and with a uniform velocity profile by the fuel-feed system and the use of the vortex generators, which is a precondition for minimizing the NOx content, and that, on the other hand, on account of the residual vortex, which is generated by the vortex generators and is still present after the mixing in the fuel/air mixture flow, the recirculation zone is influenced in a positive manner, which increases the flame stability and improves the transverse mixing of the various burners in an annular combustion chamber. Furthermore, the annular premix burner according to the invention is distinguished by simple geometry and is therefore easy to manufacture from the constructional point of view.

In addition, to form the recirculation zone which serves as ignition source for inflowing fresh fuel/air mixture, it is necessary for the inner cylinder to close after an adequate length of the annular premix section. This can be effected gradually or abruptly in an expedient manner so that either the main flow duct widens gradually or else a sudden transition is made from the annular duct to the circular duct. The recirculation zone then forms in the circular cross-section.

It is advantageous if "half" vortex generators of the delta wing type are used, in which case a vortex generator has three surfaces around which flow occurs freely and which extend in the direction of flow and of which one forms the top surface and the other two form the side surfaces, the side surfaces are flush with the same duct wall and one side surface is provided with a half sweepback angle, whereas the other side surface is straight and oriented in the direction of flow, the top surface, with an edge running transversely to the duct through which flow occurs, bears against the same duct wall as the side surfaces, and the longitudinally directed edges of the top surface, which are flush with the longitudinally directed edges of the side surfaces projecting into the flow duct, run at a setting angle to the duct wall.

When vortex generators of this type are used, which are lined up in the peripheral direction, the vortices, which all have the same direction of rotation, combine to form one large rotating vortex.

Finally, vortex generators are advantageously arranged in the premix burner which have approximately the shape of a right-angled triangle of small thickness, the two triangular side surfaces around which flow occurs running parallel to one another and enclosing together with the top surface the connecting surface, the top surface with an edge and the connecting surface with an edge bearing against the same duct wall as the two side walls.

If these vortex generators are uniformly distributed over the periphery of the two cylinder walls, specifically in such a way that two opposite vortex generators are in each case offset by half a pitch, the swirl direction at the opposing vortex generators is the same and quite a large swirl is imposed on the main flow, which swirl is sufficient for complete mixing with the fuel and also provides a residual swirl for the flame stabilization.

Further advantages of the invention follow from the subclaims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein.

Only the elements essential for understanding the invention are shown. Elements not essential to the invention, for example casings, fastenings and line leadthroughs, are not shown. The direction of flow of the working media is designated by arrows.

DESCRIPTION OF THE PREFERRED EMBODIMENTS

Figure 1:
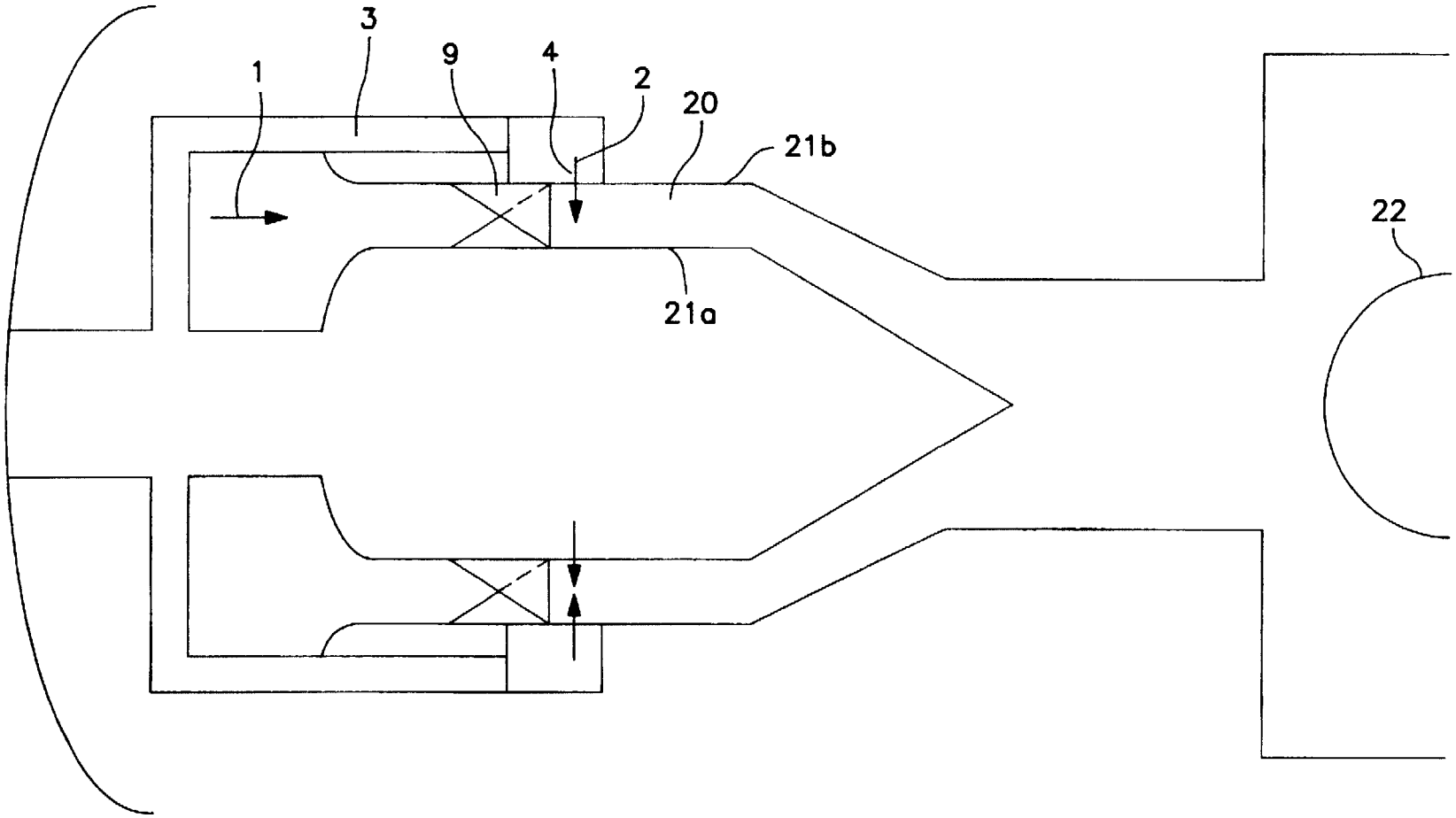
FIG. 1 shows a longitudinal section of a premix burner according to the invention.

Referring now to the drawings, wherein like reference numerals designate identical or corresponding parts throughout the several views, FIG. 1 shows in a longitudinal section a possible embodiment of the annular premix burner according to the invention. It essentially comprises two cylinders which are of different diameter from one another and are arranged concentrically to one another so that the inner cylinder wall 21*a* and the outer cylinder wall 21*b* define an annular duct 20. Arranged in the inlet area of the duct 20 are vortex generators 9, the shape and mode of operation of which will be described further below. The duct 20 has a constant height H and, downstream of the vortex generators, a length L which is in the region of 5 to 20 times its height H and forms the premix section for combustion air 1 and gaseous fuel 2. Via piping 3, gaseous fuel 2 is injected as secondary flow directly downstream of the vortex generators 9 via openings 4 in the outer cylinder wall 21*b* into the main flow of the annular duct 20 and is mixed with the combustion air 1. The introduction of the gaseous fuel 2 could of course also be effected at the inner cylinder wall 21*a* or ideally at both walls 21*a* and 21*b*, as shown in the bottom part of FIG. 1.

In the variant shown in FIG. 1, the inner cylinder wall 21*a* closes gradually after the premix section so that the inner cylinder is closed off by the apex of a cone. The outer cylinder wall 21*b* first of all likewise narrows in the region of the apex of the cone before it then encloses a circular cross-section in which a recirculation zone forms which serves as ignition source for incoming fresh fuel/air mixture.

Figure 2:
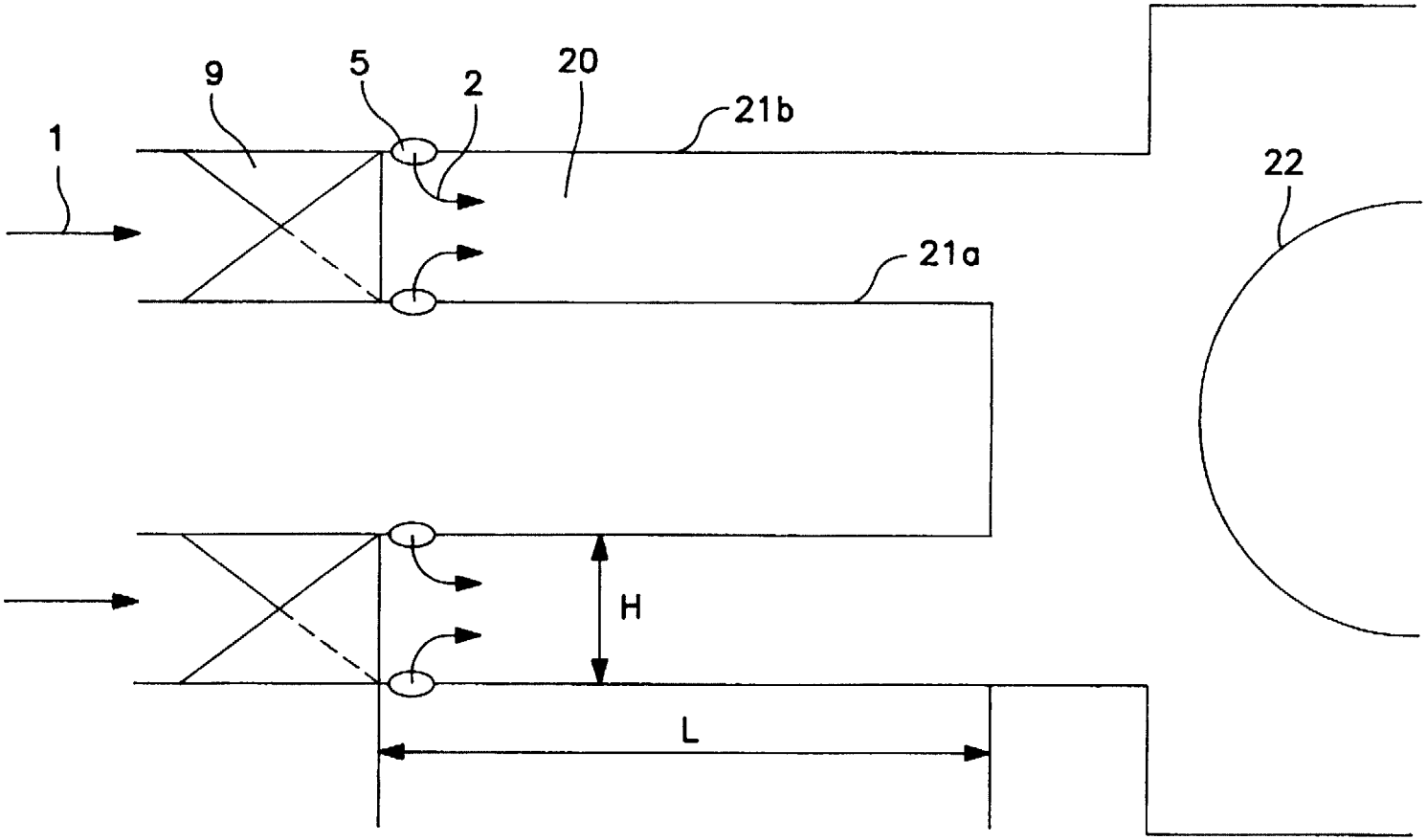
FIG. 2 shows a partial longitudinal section of a second embodiment variant of the premix burner.

FIG. 2 shows a further embodiment variant of the annular premix burner. Unlike FIG. 1, the inner cylinder here closes suddenly after a sufficiently long premix section (length L is about 5 to 20 times the duct height H) so that the transition from the annular duct 20 to the circular duct in which the recirculation zone 22 forms is effected abruptly. In this case, the gaseous fuel 2, via openings of annular fuel-feed lines 5 attached to the inner and outer cylinder directly downstream of the vortex generators 9, is introduced as secondary flow into the main flow swirled by the vortex generators and is intensively mixed with the air.

Figure 3:
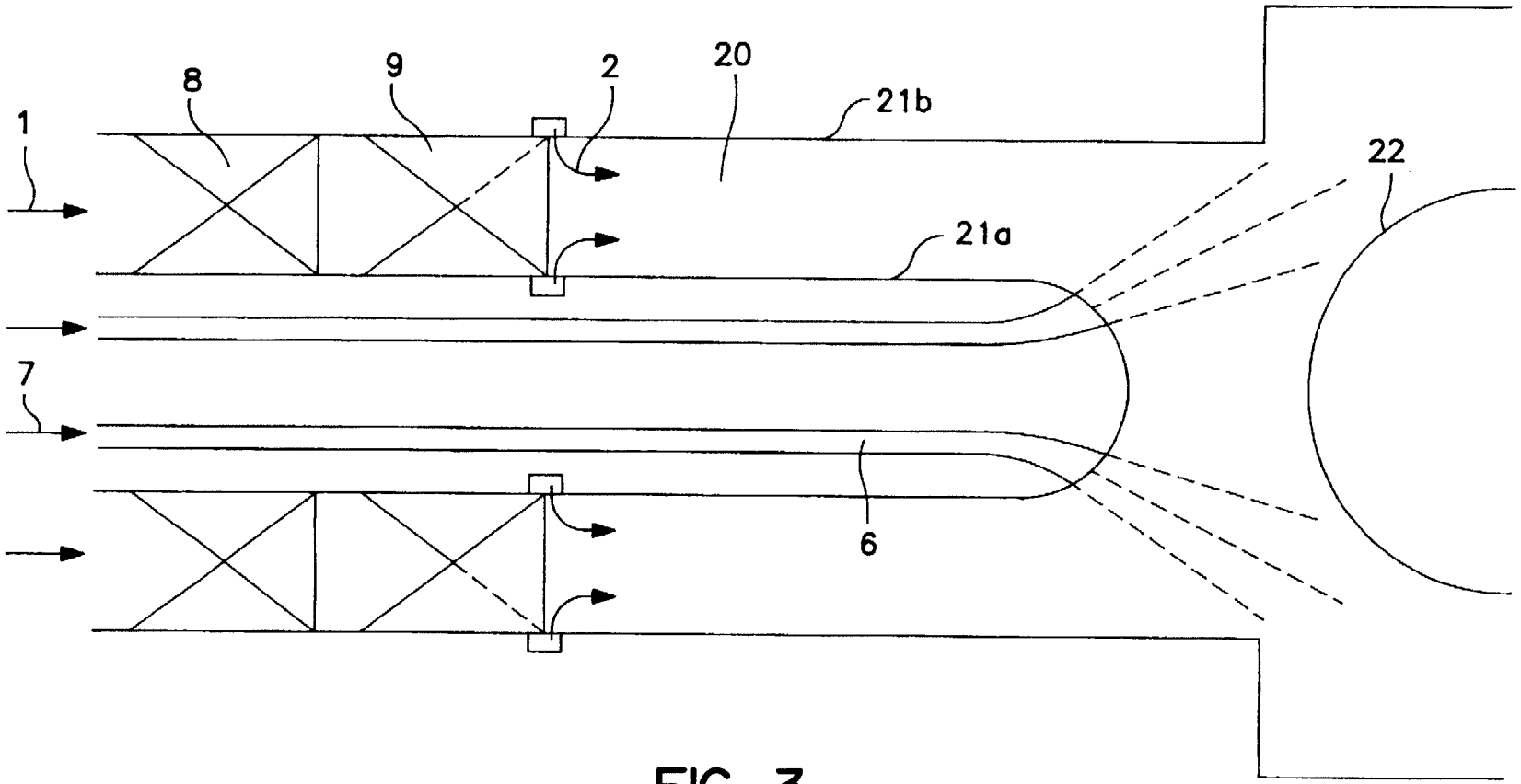
FIG. 3 shows a partial longitudinal section of a third embodiment variant of the premix burner.

FIG. 3 shows a third embodiment variant of the premix burner. As in the above examples, vortex generators 9 are arranged here too in the annular duct 20, via which vortex generators 9 the air 1 is guided and swirled as main flow before gaseous fuel is injected directly downstream of the vortex generators 9. For the purpose of intensifying the vortex effect, deflecting blades 8 are arranged in the annular duct 20 upstream of the vortex generators 9. The same effect can be achieved if the main flow passes into the annular space 20 via tangential slots (not shown here) and is thereby given a tangential velocity component. The inner cylinder also closes gradually here, although not to the apex of a cone but to a hemisphere. Lines 6 for the supply of liquid fuel 7 are arranged in the inner cylinder, which liquid fuel 7, at the end of the premix section for the combustion air 1 and the gaseous fuel, is injected into the circular cross-section of the burner from nozzles arranged in the hemispherical end of the inner cylinder.

Of course, in another embodiment variant not shown diagramatically, instead of the injection of gaseous fuel 2 into the annular duct 20, liquid fuel 7 may also be introduced, for example via a fuel lance, and mixed with the air, swirled by the vortex generators, in the annular space 20.

The vortex generators 9 installed in the annular duct 20 may have different shapes. It is essential for the invention that they generate longitudinal vortices without a recirculation area and thereby permit complete mixing of the fuel with the combustion air within the shortest section, but that on the other hand a residual vortex remains in the flow after the mixing, which residual vortex is present along the trailing part of the inner cylinder. This residual vortex influences the recirculation zone and provides for high flame stability on the one hand and good transverse mixing of the various burners in the annular combustion chamber on the other hand.

The vortex generators 9 schematically depicted in the above exemplary embodiments are half delta wings, i.e. (see FIG. 4) a vortex generator 9 has three surfaces 10, 11, 12 around which flow occurs freely and which extend in the direction of flow and of which one forms the top surface 10 and the other two form the side surfaces 11, 13, the side surfaces 11, 13 are flush with the same duct wall 21, and one side surface 11 is provided with a sweepback angle $\alpha/2$, whereas the other side surface 13 is straight and oriented in the direction of flow, the top surface 10, with an edge running transversely to the duct 20 through which flow occurs, bears against the same duct wall 21 as the side surfaces 11, 13, and the longitudinally directed edges 12, 14 of the top surface 10, which are flush with the longitudinally directed edges of the side surfaces 11, 13 projecting into the flow duct 20, run at a setting angle $\Theta$ to the duct wall 21. The two side surfaces 11, 13 enclose a connecting edge 16 with one another, which connecting edge 16 together with the longitudinally directed edges 12, 14 of the top surface 10 forms a point 18, the connecting edge running in the radial line of the curved duct wall 21. In this arrangement, the connecting edge 16 and/or the longitudinally directed edges 12, 14 of the top surface 10 are designed to be at least more or less sharp.

Figure 4:
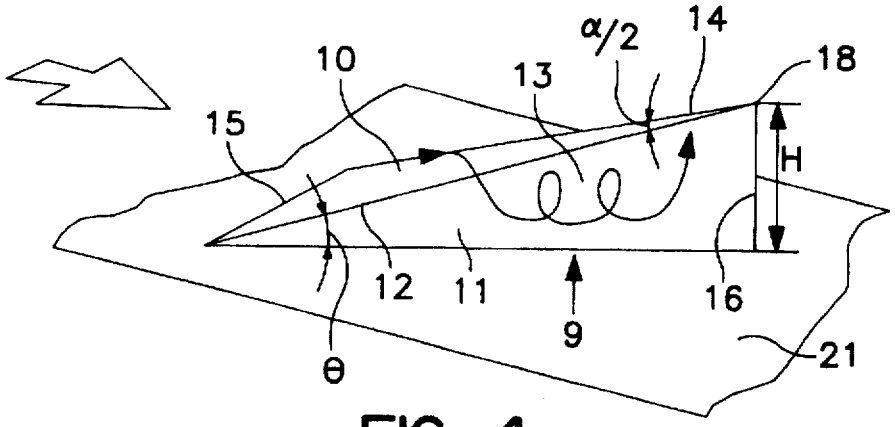
FIG. 4 shows a perspective representation of a "half" vortex generator of the delta wing type.
Figure 5:
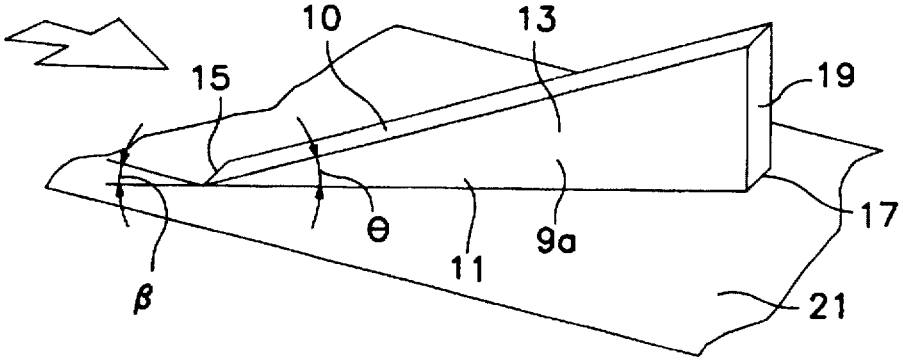
FIG. 5 shows a perspective representation of another embodiment variant of the vortex generator.
Figure 6:
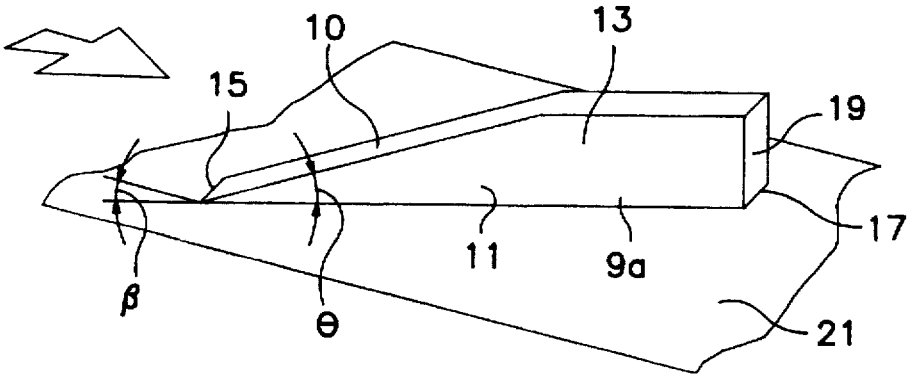
FIG. 6 shows a perspective representation of a further embodiment variant of the vortex generator.

The actual duct, through which a main flow symbolized by a large arrow passes, is not shown in FIGS. 4 to 6.

It is of advantage if the connecting edge 16 of the vortex generators 9 described in FIG. 4 forms the downstream edge of the vortex generator 9, and the edge 15 of the top surface 10 running transversely to the duct 20 through which flow occurs is the edge acted upon first by the main flow, since the vortex can thereby build up in an especially effective manner.

The mode of operation of the vortex generator is as follows: when flow occurs around the edge 14 of the side surface 11 provided with the half sweepback angle $\alpha/2$, the main flow is converted into a vortex, the axis of which lies in the axis of the main flow. No vortex is generated at the straight side surface 13 orientated in the direction of the main flow, so that a swirl is imposed on the flow and there is no vortex-neutral field. If the fuel is now directed as secondary flow as described above directly downstream of the vortex generators 9 into the main flow, intensive mixing of the combustion air 1 and the fuel 2 occurs.

FIG. 5 shows a further embodiment of a vortex generator 9*a* which can be used for the premix burner according to the invention. The vortex generator 9*a* has approximately the shape of a right-angled triangle of small thickness, the two triangular side surfaces 11, 13 around which flow occurs running parallel to one another and enclosing together with the top surface 10 the connecting surface 19, the top surface 10 with an edge 15 and the connecting surface 19 with an edge 17 bearing against the same duct wall as the two side walls 11, 13, and the two side surfaces 11, 13 forming an angle $\beta$ with the main flow direction of the incoming air. The top surface 10 may also be curved in a concave or convex form. Compared with vortex generators 9*a* having a straight top surface, this has the advantage that the same vortex intensity can be produced at a lower pressure drop. A further advantage of the vortex generators 9*a* is that they are extremely simple to manufacture, for example by punching out from thin sheet. Since the width of the top surface 10 in the case of the vortex generators 9*a* is extremely small, the vortex formation is effected virtually only on one side and a very large vortex results which has a positive effect on the fuel/air mixture formation.

FIG. 6 shows a modified embodiment of the vortex generator 9*a* shown in FIG. 5, in which the two side surfaces 11 and 13 do not have the shape of a right-angled triangle but are of trapezoidal design. These vortex generators 9*a* are also eminently suitable for the vortex generation.

FIGS. 7 to 10 show various arrangement variants of the vortex generators 9 and 9*a* respectively in the annular duct 20 of the premix burner.

Figure 7:
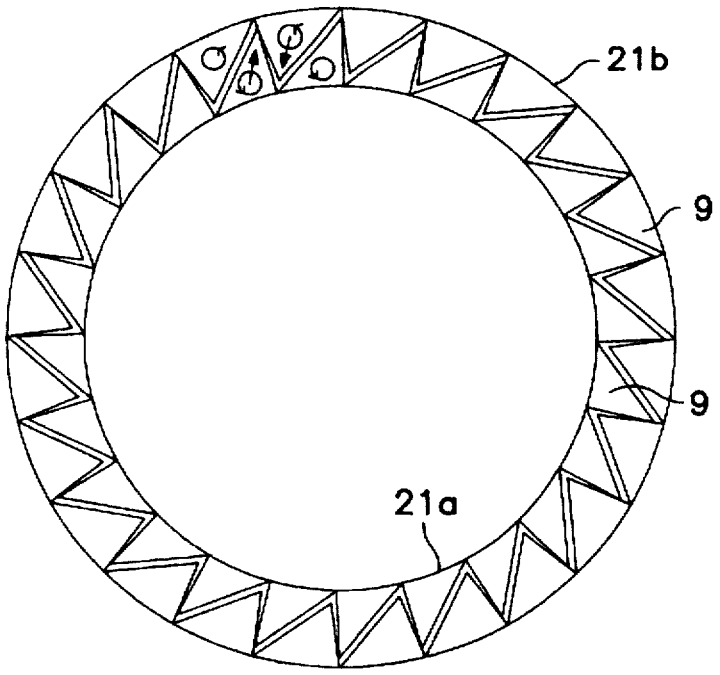
FIG. 7 shows an arrangement variant of the vortex generators according to FIG. 4 in the annular duct.

In FIG. 7, vortex generators 9 according to FIG. 4 are arranged on both the inner cylinder wall 21*a* and the outer cylinder wall 21*b*. They have a height h, which virtually fills the entire duct height H.

Figure 8:
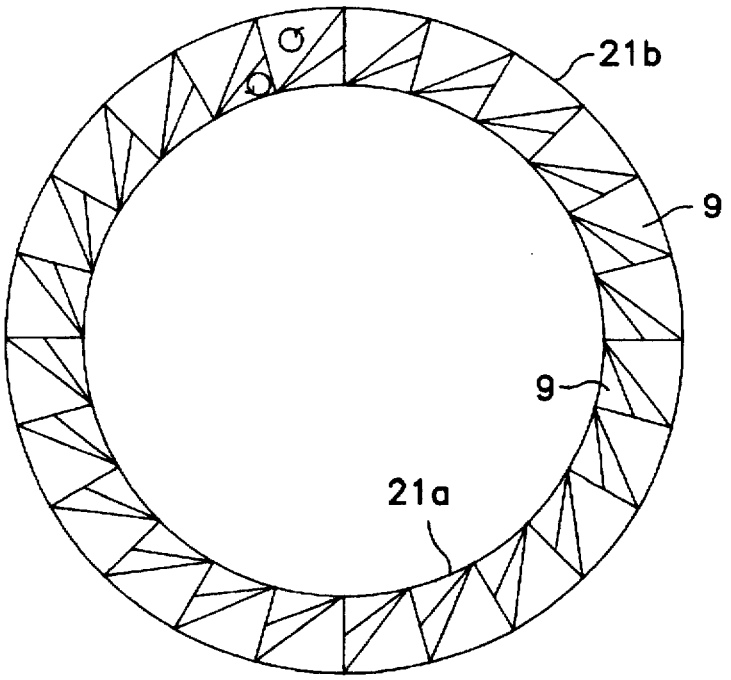
FIG. 8 shows a further arrangement variant of the vortex generators according to FIG. 4 in the annular duct.

In FIG. 8, the vortex generators 9 which are arranged on the inner cylinder wall 21*a* are smaller than those arranged on the outer wall 21*b*; their height is only about H/2, whereas the height h of the outer vortex generators 9 is equal to the duct height H. By the use of vortex generators 9 of different geometry, vortices of different intensity are produced, which has a favorable effect on the residual vortex necessary for the flame stabilization.

Figure 9:
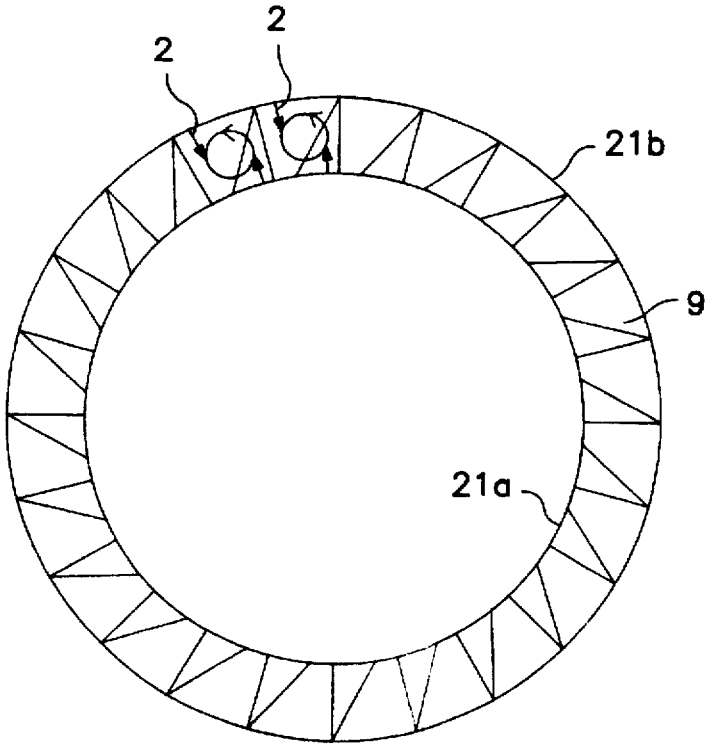
FIG. 9 shows an arrangement variant of the vortex generators according to FIG. 6 in the annular duct.

FIG. 9 shows an arrangement of vortex generators 9*a* having geometry according to FIG. 6. Their height h corresponds to the duct height H, i.e. they fill the entire duct height H. In this case, the flattened part of the top surface 10 adjoins the inner cylinder wall 21*a*. The resulting vortices are identified by arrows.

Figure 10:
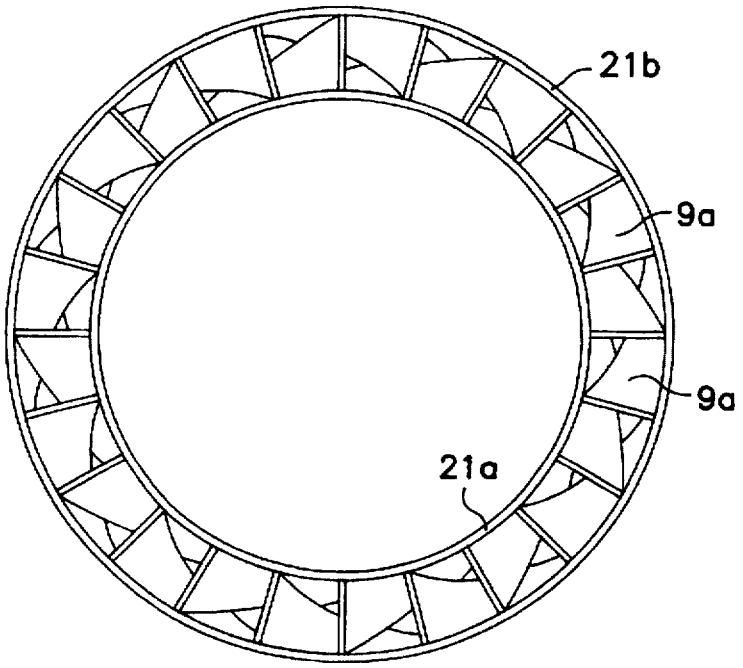
FIG. 10 shows an arrangement variant of the vortex generators according to FIG. 5 in the annular duct.

Finally, an arrangement variant of the vortex generators 9*a* according to FIG. 5 in the annular duct 20 is shown in FIG. 10. The vortex generators 9*a* are arranged on both the inner cylinder wall 21*a* and the outer cylinder wall 21*b*, for example they are welded thereon. Two opposite vortex generators 9*a* are in each case offset from one another by half a pitch in the peripheral direction so the swirl direction is the same on the outside and the inside and the vortices accumulate as desired to form one large vortex which is sufficient for the complete mixing of air and fuel and also subsequently helps as residual vortex to stabilize the flame.

The premix burner is also especially suitable for operation at part load, since, on account of the geometry of the burner, it is possible without problems to inject pilot gas or secondary gas directly into the recirculation zone. The stability limit of the burner is thereby increased.

A possible risk of flashback does not exist in the burner according to the invention, since high flow velocities prevail in the mixing zone and no recirculation areas are produced in the mixing zone by the selection of the vortex generator type described above. In addition, it is possible without problems to operate an annular combustion chamber with a plurality of premix burners according to the invention.

obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A premix burner for the combustion of gaseous and/or liquid fuel, the premix burner working with a fuel-feed system, in which the fuel is injected as secondary flow into a gaseous, ducted main flow, the secondary flow having a substantially smaller mass flow than the main flow, a premix duct (20) through which flow occurs being annular and being defined by an inner (21*a*) and an outer cylinder wall (21*b*), and a main flow being guided via vortex generators (9, 9*a*) which generate longitudinal vortices without a recirculation area and of which a plurality are arranged next to one another over the periphery of the annular duct (20) on at least one duct wall (21), and means for injecting fuel being arranged directly downstream of the vortex generators (9, 9*a*) on the inner and/or outer duct wall (21*a*, 21*b*), wherein the vortex generators (9, 9*a*) generate such vortices which leave behind a residual vortex after the complete mixing of the fuel with the air of the fuel/air mixture flow, the annular main flow duct (20) of constant height (H) and formed by the duct walls (21*a*, 21*b*) has a length (L) downstream of the vortex generators (9) and the fuel injection which is in the region of 5 to 20 times its height (H), and the annular main flow duct (20) subsequently widens by closing the inner cylinder wall (21*a*) to form a circular main flow duct.

2. The premix burner as claimed in claim 1, wherein the main flow duct widens gradually.

3. The premix burner as claimed in claim 1, wherein the main flow duct widens abruptly.

4. The premix burner as claimed in claim 1, wherein a vortex generator (9) has three surfaces (10, 11, 12) around which flow occurs freely and which extend in the direction of flow and of which one forms the top surface (10) and the other two form the side surfaces (11, 13), the side surfaces (11, 13) are flush with the same duct wall (21) and one side surface (11) is provided with a half sweepback angle ($\alpha/2$), whereas the other side surface (13) is straight and oriented in the direction of flow, the top surface (10), with an edge (15) running transversely to the duct (20) through which flow occurs, bears against the same duct wall (21) as the side surfaces (11, 13), and the longitudinally directed edges (12, 14) of the top surface (10), which are flush with the longitudinally directed edges of the side surfaces (11, 13) projecting into the flow duct (20), run at a setting angle ($\Theta$) to the duct wall (21).

5. The premix burner as claimed in claim 4, wherein the two side surfaces (11, 13) enclose a connecting edge (16) with one another which together with the longitudinally directed edges (12, 14) of the top surface (10) forms a point (18), and wherein the connecting edge runs in the radial line of the curved duct wall (21).

6. The premix burner as claimed in claim 5, wherein the connecting edge (16) and/or the longitudinally directed edges (12, 14) of the top surface are designed to be more or less sharp.

7. The premix burner as claimed in claim 6, wherein the connecting edge (16) forms the downstream edge of the vortex generator (9), and the edge (15) of the top surface (10) running transversely to the duct (20) through which flow occurs is the edge acted upon first by the main flow.

8. The premix burner as claimed in claim 1, wherein the vortex generators (9*a*) have approximately the shape of a right-angled triangle of small thickness, the two triangular side surfaces (11, 13) around which flow occurs run parallel to one another and enclose together with a top surface (10) a connecting surface (19), the top surface (10) with an edge (15) and the connecting surface (19) with an edge (17) bearing against the same duct wall as the two side walls (11, 13), and the side surfaces (11, 13) forming an angle ($\beta$) with the main flow direction of the incoming air.

9. The premix burner as claimed in claim 8, wherein the side surfaces (11, 13) of the vortex generators (9*a*) are of trapezoidal design.

10. The premix burner as claimed in claim 8, wherein the top surface (10) is designed to be convex or concave.

11. The premix burner as claimed in claim 8, wherein the connecting surface (19) forms the downstream surface of the vortex generator (9*a*), and the edge (15) of the top surface (10) running transversely to the duct (20) through which flow occurs is the edge acted upon first by the main flow.

12. The premix burner as claimed in claim 4, wherein the height (h) of the vortex generator (9, 9*a*) corresponds to the height (H) of the duct (20).

13. The premix burner as claimed in claim 4, wherein an identical number of vortex generators (9, 9*a*) are arranged on the inner duct wall (21*a*) and on the outer duct wall (21*b*), in which case two opposite vortex generators (9, 9*a*) each are offset by half a pitch.

14. The premix burner as claimed in claim 4, wherein an identical number of vortex generators (9, 9*a*) are arranged on the inner duct wall (21*a*) and on the outer duct wall (21*b*), the inner and the outer vortex generators (9, 9*a*) having a different geometry.

15. The premix burner as claimed in claim 1, wherein gaseous fuel is fed via openings in the inner and/or outer duct wall (21*a*, 21*b*) downstream of the vortex generators (9, 9*a*).

16. The premix burner as claimed in claim 1, wherein liquid fuel is injected via a lance arranged downstream of the vortex generators (9, 9*a*).

17. The premix burner as claimed in claim 15, wherein additionally, liquid fuel is injected at the end of the inner cylinder.

* * * * *